United States Patent [19]

Watanabe et al.

[11] 4,006,015

[45] Feb. 1, 1977

[54] NI-CR-W ALLOYS

[75] Inventors: Rikizo Watanabe; Yoshitaka Chiba, both of Yasugi, Japan

[73] Assignee: Hitachi Metals, Ltd., Japan

[22] Filed: July 29, 1975

[21] Appl. No.: 600,120

[52] U.S. Cl. ..... 75/171; 148/32

[51] Int. Cl.[2] ..... C22C 19/05

[58] Field of Search ..... 75/171, 170; 148/32, 148/32.5

[56] References Cited

UNITED STATES PATENTS 3,403,998 10/1968 Ornitz et al. ..... 75/171

*Primary Examiner*—R. Dean

*Attorney, Agent, or Firm*—Craig & Antonelli

[57] ABSTRACT

The present invention provides Ni-Cr-W alloys consisting essentially of, by weight, 0.001 – 0.1% carbon, 0.05 – 0.7% titanium and/or niobium, 18 – 25% chromium and 16 – 22% tungsten, the total content of chromium plus tungsten being from 38 to 44% and the balance being essentially nickel with incidental impurities.

26 Claims, 2 Drawing Figures

NI-CR-W ALLOYS

The present invention relates to heat resistant alloys having good workability and high strength at high temperatures, for use as various heat resistant parts for a gas turbine and for many kinds of heating furnaces. Particularly, the heat resistant alloys of the present invention are most suitable for a heat exchanger of a high temperature gas-cooled reactor for atomic energy steel-making, having a good combination of high long-term creep rupture strength at about 1000° C and good workability.

Prior heat resistant Ni-Cr-Fe alloys (Incoloy), heat resistant and oxidation resistant Ni-Cr alloys (Inconel) and corrosion resistant high nickel alloys (Hastelloy) have a good workability and a variety of uses, e.g., rods, sheets, pipes and forged articles, but have an insufficient strength at high temperatures. Therefore, these prior alloys can be used only at lower temperature.

The object of the present invention is to provide heat resistant alloys having higher strength at high temperatures than those of the prior heat resistant Ni-Cr-Fe alloys, heat resistant and oxidation resistant Ni-Cr alloys and corrosion resistant high nickel alloys, and having good workability. The heat resistant alloys of the present invention are Ni-Cr-W alloys exhibiting an excellent long-term creep rupture strength when used at about 1000° C. or higher, and good workability.

The present inventors have investigated the properties of various elements affecting the property of the Ni-Cr-W alloys. As a result, the proper content of each of carbon, titanium or niobium, chromium, tungsten and nickel and a certain range of % chromium plus % tungsten have been found. Further, according to the present invention, proper amounts of magnesium, boron, zirconium, yttrium, hafnium and aluminum may be contained in addition to the above-mentioned components for the purpose of improving creep rupture strength and, oxidation resistance of said alloys at high temperature.

According to the present invention, there are provided Ni-Cr-W alloys consisting essentially of, by weight, 0.001 – 0.1% carbon, 0.05 – 0.7% titanium and/or niobium, 18 – 25% chromium and 16 – 22% tungsten, the total content of chromium plus tungsten being from 36 to 44%, and the balance being essentially nickel with incidental impurities.

Figure 1:
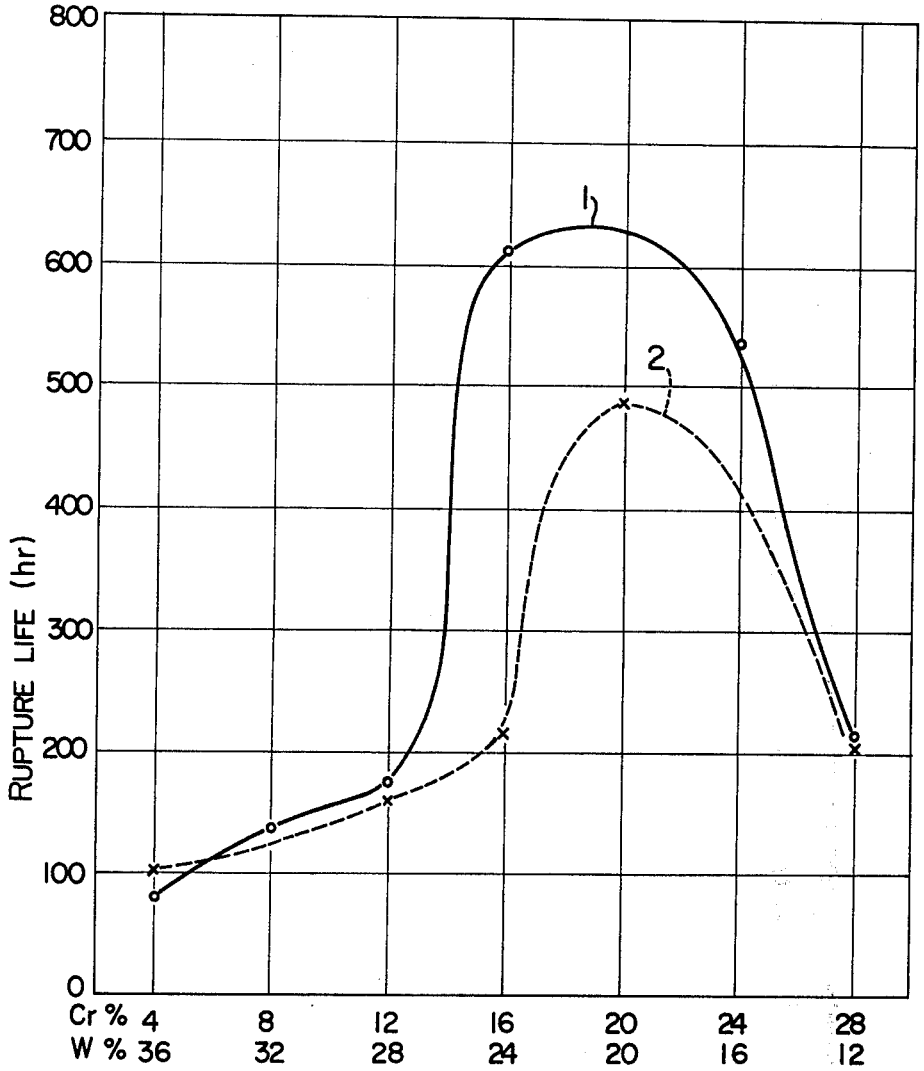
Figure 2:
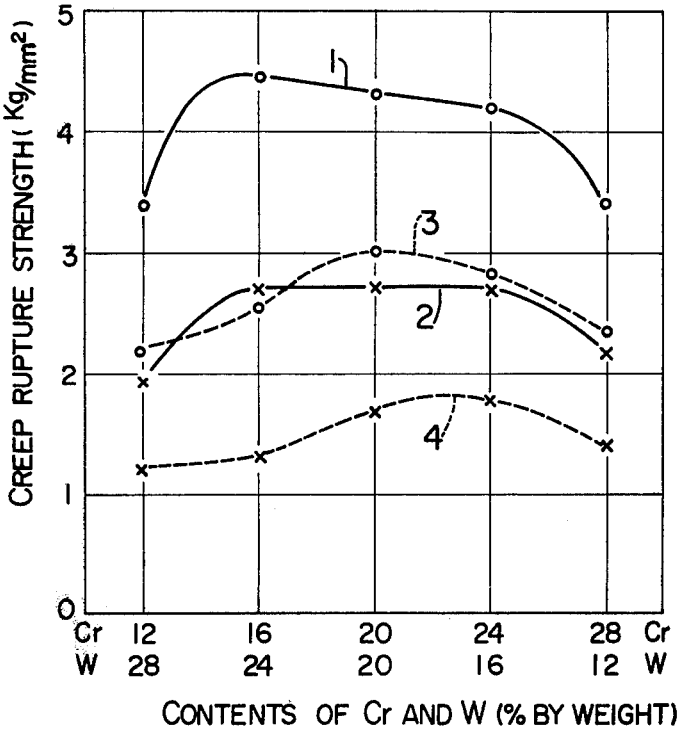

FIGS. 1 and 2 show the change of creep rupture strength at 1000° C. and 1050° with respect to the chromium content and the tungsten content when the total content of chromium plus tungsten is 40% by weight.

The correlation among the nickel, chromium and tungsten contents is important to the Ni-Cr-W alloys of the present invention.

Both chromium and tungsten as solid solution strengthening elements decrease stacking fault energy of the alloys and lower diffusion coefficient of the alloy so that high temperature stength of the alloy is raised. Therefore, the more of these elements are contained in the alloy, the higher the high temperature strength of the alloy becomes, unless the contents exceed certain limits. If chromium and tungsten contents exceed certain limits, the structure of the alloy will be unstable and the alloy will lose desired properties. The stacking fault energy of an alloy can be rated by average electron vacancy number Nv. The stacking fault energy is lowered with Nv being increased. The Nv of the Ni-Cr-W alloy can be calculated by the following equation:

$$Nv = 0.66\ C_{Ni} + 4.66\ (C_{Cr} + C_W)$$

wherein $C_{Ni}$, $C_{Cr}$ and $C_W$ represent atomic ratios of nickel, chromium and tungsten, respectively. The diffusion coefficient of an alloy can be rated by lattice constant $a$. The diffusion coefficient is lowered with $a$ being increased. The $a$ of the Ni-Cr-W alloy can be calculated by the following equation:

$$a + 3.524 + 0.130\ C_{Cr} + 0.421\ C_W(A)$$

The limits of contents beyond which the structure of an alloy is unstable are determined by critical electron vacancy numbers $N^c$. If $N_v$ is less than $N^c$, the structure is stable and if Nv is more than $N^c$, the structure is unstable. The $N^c$ at 850° C. of Ni-Cr-W alloys can be calculated by the following equation:

$$N^c + 2.2792\ f_{Cr} = 1.2837\ f_W$$

wherein $f_{Cr}$ and $f_W$ represent atomic ratios of chromium and tungsten, respectively, provided that $f_{Cr} + f_w = 1$. Although Nv should be less than $N^c$, and $a$ and Nv should be as large as possible in order to obtain an alloy having higher strength at high temperatures, both $a$ and Nv are increased when the content of chromium or tungsten is separately increased. Therefore, the lower limit of 3.580 A was given for $a$ of Ni-Cr-W alloys, and the chromium content and the tungsten content were changed at an increment of 4% by weight from 0 to 48% by weight and from 0 to 40% by weight, respectively. Thus, compositions satisfying the two requirements of $a \geqq 3.580$ A and $N^c \geqq$ Nv have been selected from all the combinations of the chromium contents and the tungsten contents as changed above, and they are reported in Table 1.

Table 1

| Cr (wt. %) | W (wt. %) | Ni | Cr + W (wt. %) | $N^c$-Nv | Nv | a (A) |
|---|---|---|---|---|---|---|
| 0 | 36 | Bal. | 36 | 0.02 | 1.27 | 3.589 |
| 4 | 32 | Bal. | 36 | 0.19 | 1.41 | 3.587 |
| 4 | 36 | Bal. | 40 | 0.07 | 1.51 | 3.596 |
| 8 | 28 | Bal. | 36 | 0.25 | 1.54 | 3.585 |
| 8 | 32 | Bal. | 40 | 0.13 | 1.64 | 3.594 |
| 12 | 24 | Bal. | 36 | 0.27 | 1.66 | 3.583 |
| 12 | 28 | Bal. | 40 | 0.14 | 1.76 | 3.591 |
| 12 | 32 | Bal. | 44 | 0.01 | 1.86 | 3.601 |
| 16 | 20 | Bal. | 36 | 0.26 | 1.77 | 3.581 |
| 16 | 24 | Bal. | 40 | 0.13 | 1.87 | 3.590 |
| 20 | 20 | Bal. | 40 | 0.10 | 1.97 | 3.588 |
| 24 | 16 | Bal. | 40 | 0.07 | 2.06 | 3.586 |
| 28 | 12 | Bal. | 40 | 0.03 | 2.15 | 3.584 |

It is found from Table 1 that in order to allow an alloy to have a sufficiently high strength at high temperature the total content of chromium and tungsten must be within the range of 36 – 44% by weight. Real relationship between the total content of chromium plus tungsten and the creep rupture strength at 1000° C. and 3 kg/mm² for various combinations of the chromium contents and the tungsten contents is shown in Table 2.

Table 2

| % Cr | % W | (% Cr) + (% W) | Rupture life (hrs.) | Elongation (%) |
|---|---|---|---|---|
| 16 | 16 | 32 | 137 | 54 |
| 20 | 12 | 32 | 163 | 68 |
| 20 | 20 | 40 | 494 | 62 |
| 24 | 16 | 40 | 534 | 33 |

Table 2-continued

| % Cr | % W | (% Cr) + (% W) | Rupture life (hrs.) | Elongation (%) |
|---|---|---|---|---|
| 24 | 24 | 48 | 75 | 5 |
| 28 | 20 | 48 | 118 | 17 |

Thus, alloy compositions having the total content of chromium plus tungsten in the range of 36 – 44% have further been studied and more desirable alloy compositions have been selected for the present invention.

Where the total content of tungsten and chromium is constant, it is found from Table 1 that as % Cr increases Nv becomes greater but *a* is reduced. To the contrary, as % W increases *a* becomes greater but Nv is reduced. Both *a* and Nv are of importance to the high temperature strength of the alloys. The high temperature strength of the alloys must be highest at the range where these contents are most properly balanced. When the total content of chromium and tungsten is maintained at 40% by weight, creep rupture life is found to change, as shown in FIG. 1, as the chromium to tungsten ratio is changed. The maximum creep rupture strength is obtained at 14 – 30% chromium and 10 – 26% tungsten. Curves 1 and 2 represent the changes of creep rupture life at 1000° C. and 3 kg/mm² and at 1050° C. and 2 kg/mm², respectively. Further, relationships of the creep rupture strength with the chromium content and the tungsten content are shown in FIG. 2. Curves 1, 2, 3 and 4 represent the relationships of the creep rupture strength with the chromium content and the tungsten content at 1000° C. — 100 hrs., 1000° C — 1000 hrs., 1050° C — 100 hrs. and 1050° C — 1000 hrs., respectively. From FIG. 2 it is found that the creep rupture strength is at the maximum in vicinity of a composition of 20% CR – 20% W and reduced on both the sides of low chromium - high tungsten and high chromium - low tungsten. This means that chromium has effect mainly on the reduction of the stacking fault energy of the alloy while tungsten has effect mainly on the reduction of diffusion coefficient of the alloy and, therefore, the optimum balancing of both the effects is very important to the increase of creep rupture strength. However, also in the vicinity of 20% Cr – 20% W, we can see from FIG. 2 that the position at which the maximum creep rupture strength is revealed tends to migrate from the side of low chromium-high tungsten to the side of high chromium - low tungsten, as the time and temperature become longer and higher. In order to investigate the optimum balancing of the chromium and tungsten contents further in detail, three alloy compositions, the total content of chromium plus tungsten being 41%, have been examined. As a result, it has been found that the alloy, having the total content of chromium plus tungsten being 41%, has higher creep rupture strength than the alloy, the total content of chromium plus tungsten being 40%, and further that in the shorter period side the alloy having higher tungsten content has higher strength whereas in the longer period side, the alloy having lower tungsten content has higher creep rupture strength, that is, the long term creep rupture strength is increased in the order of 19% Cr – 22% W, 21% Cr – 20% W and 23% Cr – 18% W. Further, it has been found that 23% Cr-18% W alloy is excellent also with respect to the minimum creep rate under the same stress. Therefore, the alloys of the present invention contain preferably 18 – 25% Cr and 16 – 22% W, the total content of chromium plus tungsten being from 36 to 44%, more preferably 21 – 25% Cr and 16 – 20% W, the total content of chromium plus tungsten being from 39 to 43%. The optimum alloy contains about 23% Cr and about 18% W.

Tungsten has a greater solid solution strengthening effect on the alloys than molybdenum with respect to long term creep rupture strength at high temperature. Therefore, the present invention provides Ni - Cr - W alloys which positively exclude molybdenum and include tungsten in place of molybdenum.

Cobalt lowers oxidation resistance of the alloys and raises the price of the alloys, therefore, cobalt is not allowed to be incorporated into the alloys as an alloying element, although a slight amount of cobalt is allowed to be included as an impurity. Further, iron reduces the solid solubility of each of chromium and tungsten in the alloy of the present invention and tends to form a harmful intermetallic compound. Thus, the incorporation of iron in the alloy of the present invention is not desired. Up to 1% iron, by weight, is allowable as an incidental impurity. Silicon and manganese also are not desired, because they unstabilize the structure of the alloy of the present invention and cause the alloy to form a harmful intermetallic compound. Up to 0.5% by weight each of silicon and manganese is allowable as incidental impurities.

In the alloy of the present invention carbon is combined with titanium or niobium to form MC type carbide. A small amount of carbon is needed to prevent excessive grain coarsening, but an excessive amount of carbon combines with tungsten or chromium which is dissolved in the matrix of the alloy to form a $M_6C$ or $M_{23}C_6$ type carbide, thus, the amounts of the solid solution strengthening elements are reduced. Particularly, the creep long-term strength is objectionably lowered. In order to find a proper carbon content in the alloy of the present invention, four alloy samples having a composition of 23 Cr - 18 W - 0.35 Ti - 0.1 Zr - Bal. Ni in which the carbon content was changed from 0.03 to 0.14% were subjected to a creep rupture test at 1000° C. - 3 kg/mm². The result is shown in Table 3.

Table 3

| C content (%) | Rupture life (hr.) | Elongation (%) |
|---|---|---|
| 0.03 | 1088 | 38 |
| 0.09 | 1029 | 35 |
| 0.13 | 927 | 30 |
| 0.14 | 620 | 33 |

When the carbon content exceeds 0.1% the creep rupture life is reduced to about 3/5. The higher the carbon content is, the earlier the alloy reaches an accelerated creep state. Thus, the carbon content should be not more than 0.1% in the present invention. In order to obtain the effect of carbon, not less than 0.001% of carbon is necessary. That is, the carbon content should be from 0.001 to 0.1%. For applications at high temperatures for a long period of time the carbon content should be not more than 0.06%, preferably being from 0.01 to 0.06%. The optimum carbon content is 0.03%.

Titanium or niobium is combined with carbon to form a MC type carbide, which prevents excessive grain growth. Therefore, a small amount of titanium or niobium is required. If the content of titanium, niobium or a mixture thereof exceeds 1%, the structure of the alloy becomes unstable. Therefore, the content of titanium, niobium or a mixture thereof should be not more than 1%. Particularly in order to improve the workability as well as the strength at high temperatures said content should be limited to not more than 0.7%. However, in order to obtain the effect of titanium or niobium, said content should be not less than 0.05%. That is, said content should be from 0.05 to 0.7%, preferably from 0.1 to 0.6%. The optimum content should be about 0.3%. As an example, the relationship between the various combinations of the titanium and the niobium content and the creep rupture strength at 1000° C. - 3 kg/mm² in an 23% Cr - 18% W alloy are reported in Table 4.

Table 4

| Ti content (%) | Nb content (%) | Rupture life (hr.) | Elongation (%) |
|---|---|---|---|
| 0.4 | — | 632 | 34 |
| — | 0.5 | 480 | 27 |
| 0.2 | 0.3 | 556 | 33 |
| — | — | 281 | 22 |

From the comparison of the alloy having the above-indicated contents of chromium, tungsten and nickel with titanium, niobium or a mixture thereof contained therein and the same alloy without titanium nor niobium contained therein, it can be seen that the alloy with titanium, niobium or a mixture thereof contained therein has a greater creep rupture strength, particularly titanium gives more excellent properties to the alloy of the present invention than niobium.

When the alloy is used at high temperatures, the creep caused by grain boundary diffusion becomes a problem. Thus, alloying elements capable of inhibiting the grain boundary diffusion are important to be added to raise the high temperature strength of the alloy. At grain boundaries there are many vacancies because of the disorder in the arrangement of atoms. The diffusion of atoms through these vacancies take place particularly at high temperatures. Therefore, the rate of the grain boundary diffusion can be reduced by adding to the alloy such elements as filling up these vacancies. Such elements should have an atomic radius different from that of the elements constituting the matrix and must segregate predominantly at grain boundaries. As such elements, magnesium, boron, zirconium, yttrium and hafnium are usable. The solid solubility of any of these elements in the matrix is very low. These elements segregate predominantly at grain boundaries when added to the alloy in small amounts. Boron has an atomic radius smaller than that of the elements constituting the matrix. To the contrary, magnesium, zirconium, yttrium and hafnium have a greater atomic radius. These elements all act as occupying the vacancies at grain boundaries. Particularly, the alloy containing zirconium has a good creep resistance. These elements form objectionable intermetallic compounds when added in excessive amounts. Therefore, the contents of magnesium, boron, zirconium, yttrium and hafnium should be limited to not more than 0.1%, not more than 0.1, not more than 0.5%, not more than 0.5% and not more than 1%, respectively. The alloy containing 0.001 – 0.05% magnesium, 0.001 – 0.05% boron, 0.01 – 0.12% zirconium, 0.005 – 0.2% yttrium or 0.01 – 0.5% hafnium has good long-term high temperature strength. Preferred contents of magnesium, boron, zirconium, yttrium and hafnium are in the ranges of 0.001 – 0.02%, 0.001 – 0.01%, 0.02 – 0.08%, 0.01 – 0.1% and 0.05 – 0.3%, respectively. The optimum content of zirconium is 0.05%.

Aluminum forms a dense oxide film on the surface of the alloy, thus greatly improve the oxidation resistance of the alloy protecting the inner of the alloy. If the excess of aluminum is contained, however, the structure of the alloy becomes unstable. Therefore, the aluminum content should be limited to not more than 1.5%. According to the present invention, the aluminum content should be limited to a range of 0.1 – 1.0%, preferably 0.1 – 0.5%.

According to the present invention, there is provided an alloy containing about 23% chromium, about 18% tungsten, the balance being nickel, and further containing minor amounts of carbon, and titanium, niobium or a mixture thereof, which has the best properties, and in which alloy there is further contained one or more of magnesium, boron, zirconium, yttrium, hafnium and aluminum to raise the high temperature strength and the oxidation resistance. Particularly when the alloy comprises the indicated contents of carbon, chromium, tungsten and nickel and the optimum contents of titanium and zirconium it can have more excellent properties.

The present invention provides Ni - Cr - W alloys containing, by weight, 0.001 – 0.1% carbon, 0.05 – 0.7% titanium, niobium or a mixture thereof, 18 – 25% chromium and 16 – 22% tungsten, the total content of chromium plus tungsten being from 36 to 44% and the balance essentially being nickel with incidental impurities. In order to obtain a stable creep property, one or more selected from the group consisting of, by weight, 0.001 – 0.05% magnesium, 0.001 – 0.05% boron, 0.01 – 0.12% zirconium, 0.005 – 0.2% yttrium and 0.01 – 0.5% hafnium may be contained in said alloys. Further, in order to improve the oxidation resistance, by weight, 0.1 – 1.0% aluminum may be contained in said alloys.

Ni - Cr - W alloys containing, by weight, 0.001 – 0.06% carbon, 0.1 – 0.6% titanium, niobium or a mixture thereof, 21 – 25% chromium, 16 – 20% tungsten, the total content of chromium plus tungsten being from 39 to 43% and the balance being essentially nickel with incidental impurities are preferred for use under conditions requiring higher long-term creep rupture strength and very good workability. Further, since the alloys are required to have stabilized grain boundaries when subjected to heating at high temperature for a long period of time, they should contain preferably at least one selected from the group consisting of, by weight, 0.001 – 0.02% magnesium, 0.001 – 0.01% boron, 0.02 – 0.08% zirconium, 0.01 – 0.1% yttrium and 0.05 – 0.3% hafnium. Furthermore, in order to improve the oxidation resistance the aluminum content should be preferably in a range of 0.1 – 0.5% by weight. The preferred alloys of the present invention contain a balanced cmposition of, by weight, 16 – 20% tungsten for about 23% chromium or 21 – 25% chromium for about 18% tungsten.

The preferred alloy compositions of the present invention comprise combinations of proper contents of carbon, chromium, tungsten, nickel with titanium and zirconium, or with titanium, zirconium and magnesium. That is, the optimum alloy composition of the present invention consists essentially of, by weight, about 0.03% carbon, about 23% chromium, about 18% tungsten, the total content of chromium plus tungsten being about 41%, about 0.3% titanium and about 0.05% zirconium, and the balance being essentially nickel with incidental impurities.

The present invention is illustrated below by some examples.

Table 5 shows chemical analysis of the alloys of the present invention and prior arts and of experimental alloys having compositions other than those of the present invention, which were used as samples for comparison in high temperature strength. Alloy No. 31 is the strongest one among the prior corrosion resistant, high nickel content and solid solution strengthened alloys (Hastelloy). Alloy No. 32 is the strongest one among the prior heat and oxidation resistant, solid solution strengthened Ni - Cr alloys (Inconel). Alloy No. 34 is the strongest one among the prior heat resistant, solid solution strengthened Ni - Cr - Fe alloys (Incoloy).

The alloys of the present invention exhibited a good hot workability when they were forged. Alloys Nos. 1 and 2, and the experimental alloys were solutioned at 1275° C for 1 hour followed by air-cool and the other alloys of the present invention were solutioned at 1250° C for 1 hour followed by air-cool. Further, the prior alloys were subjected to the respective standard heat treatments. All these alloys were then subjected to the creep rupture test.

Table 5

| Alloy No. | | Chemical Analysis (weight %) | | | | | | | | | | | | | |
|---|---|---|---|---|---|---|---|---|---|---|---|---|---|---|---|
| | | C | Si | Mn | Ni | Cr | Mo | W | Co | Fe | Al | Ti | B | Zr | Others |
| Alloys of the Present Invention | 1 | 0.04 | — | — | Bal. | 19.8 | — | 20.6 | — | — | — | 0.5 | — | 0.03 | |
| | 2 | 0.05 | — | — | Bal. | 23.7 | — | 16.7 | — | — | — | 0.6 | — | 0.03 | |
| | 3 | 0.03 | — | — | Bal. | 19.2 | — | 21.4 | — | — | — | 0.4 | — | — | |
| | 4 | 0.05 | — | — | Bal. | 22.7 | — | 17.4 | — | — | — | 0.5 | — | — | |
| | 5 | 0.03 | — | — | Bal. | 19.1 | — | 21.4 | — | — | — | 0.4 | — | 0.07 | |
| | 6 | 0.04 | — | — | Bal. | 23.1 | — | 17.8 | — | — | — | 0.4 | — | — | |
| | 7 | 0.06 | — | — | Bal. | 22.1 | — | 16.8 | — | — | — | — | — | — | Nb 0.5 |
| | 8 | 0.03 | — | — | Bal. | 20.8 | — | 19.5 | — | — | — | 0.5 | — | — | Hf 0.1 |
| | 9 | 0.03 | — | — | Bal. | 21.7 | — | 18.8 | — | — | — | — | — | 0.05 | Nb 0.4 |
| | 10 | 0.05 | — | — | Bal. | 22.9 | — | 17.7 | — | — | — | 0.2 | — | — | Nb 0.3 |
| | 11 | 0.04 | — | — | Bal. | 23.1 | — | 17.5 | — | — | — | 0.5 | 0.014 | — | |
| | 12 | 0.02 | — | — | Bal. | 22.8 | — | 18.1 | — | — | — | 0.3 | — | — | Y 0.06 |
| | 13 | 0.04 | — | — | Bal. | 21.5 | — | 19.7 | — | — | 0.6 | 0.4 | — | — | |
| | 14 | 0.02 | — | — | Bal. | 21.6 | — | 19.8 | — | — | — | 0.4 | — | 0.04 | |
| | 15 | 0.02 | — | — | Bal. | 22.9 | — | 17.3 | — | — | — | 0.5 | — | 0.06 | |
| | 16 | 0.03 | — | — | Bal. | 23.1 | — | 18.0 | — | — | — | 0.4 | — | 0.11 | |
| | 17 | 0.02 | — | — | Bal. | 23.0 | — | 17.8 | — | — | — | 0.3 | — | 0.06 | Mg 0.004 |
| | 18 | 0.02 | — | — | Bal. | 23.3 | — | 17.5 | — | — | — | 0.3 | — | 0.06 | Mg 0.009 |
| Experimental Alloys | 21 | 0.05 | — | — | Bal. | 4.0 | — | 36.0 | — | — | — | — | — | — | |
| | 22 | 0.05 | — | — | Bal. | 7.9 | — | 32.3 | — | — | — | 0.6 | — | 0.05 | |
| | 23 | 0.04 | — | — | Bal. | 12.0 | — | 28.3 | — | — | — | 0.5 | — | 0.04 | |
| Prior Alloys | 31 | 0.04 | 0.4 | 0.8 | Bal. | 15.5 | 15.8 | 3.6 | — | 5.6 | — | — | — | — | V 0.3 |
| | 32 | 0.03 | 0.4 | — | Bal. | 20.5 | 8.5 | — | 12.0 | — | 1.2 | 0.4 | 0.003 | — | |
| | 33 | 0.03 | 0.3 | 0.2 | Bal. | 22.0 | 9.1 | — | — | 2.0 | — | — | — | — | Nb 3.4 |
| | 34 | 0.06 | 0.7 | 0.6 | 40.0 | 20.1 | — | 4.7 | 8.5 | Bal. | 0.3 | 0.3 | — | — | |

Table 6 shows the results of the creep rupture test at 1000° C. - 3 kg/mm².

Table 6

| Alloy No. | | Rupture life (hr.) | Elongation (%) |
|---|---|---|---|
| | 1 | 494 | 62 |
| | 2 | 534 | 33 |
| | 3 | 521 | 55 |
| | 4 | 608 | 32 |
| | 5 | 639 | 61 |

Table 6-continued

| Alloy No. | | Rupture life (hr.) | Elongation (%) |
|---|---|---|---|
| Alloys of the Present Invention | 6 | 632 | 34 |
| | 7 | 480 | 27 |
| | 8 | 762 | 26 |
| | 9 | 653 | 34 |
| | 10 | 556 | 33 |
| | 11 | 957 | 35 |
| | 12 | 723 | 36 |
| | 13 | 641 | 36 |
| | 14 | 660 | 62 |
| | 15 | 1017 | 33 |
| | 16 | 1088 | 38 |
| | 17 | 1089 | 28 |
| | 18 | 1105 | 38 |
| Experimental Alloys | 21 | 80 | 15 |
| | 22 | 136 | 50 |
| | 23 | 176 | 56 |
| Prior Alloys | 31 | 133 | 39 |
| | 32 | 154 | 25 |
| | 33 | 26 | 96 |
| | 34 | 46 | 27 |

From Table 6 it can be seen that the alloys of the present invention have a higher creep rupture strength than both of the experimental alloys and the prior alloys. The long-term creep rupture strength is important to many practical heat-resistant materials. The alloys of the present invention having the chromium, tungsten and nickel contents as restricted above in accordance with the relations between these contents discovered by the present inventors exhibit very high creep rupture strength and good workability and are very suitable for use as heat resistant parts.

As mentioned above, the alloys of the present invention are capable of being shaped in a rod, sheet, tube, pipe, or forgings and are suitable for use as various parts of gas turbines, or for various heating furnace materials, particularly for a heat exchanger of a high temperature gas-cooled reactor for atomic energy steel-making.

What is claimed is:

1. A Ni-Cr-W alloy, which consists essentially of, by weight, 0.001 – 0.1% carbon, 0.05 – 0.7% titanium, niobium or a mixture thereof, 18 – 25% chromium and 16 – 22% tungsten, the total content of chromium plus tungsten being from 36 to 44%, the balance being essentially nickel with incidental impurities.

2. A Ni-Cr-W alloy, which consists essentially of, by weight, 0.001 – 0.1% carbon, 0.05 – 0.7% titanium, niobium or a mixture thereof, 18 – 25% chromium and 16 – 22% tungsten, the total content of chromium plus tungsten being from 36 to 44%, further containing at least one selected from the group consisting of 0.001 – 0.05% magnesium, 0.001 – 0.05% boron, 0.01 – 0.12% zirconium, 0.005 – 0.2% yttrium and 0.01 – 0.5% hafnium, and the balance being essentially nickel with incidental impurities.

3. A Ni-Cr-W alloy, which consists essentially of, by weight, 0.001 – 0.1% carbon, 0.05 – 0.7% titanium, niobium or a mixture thereof, 18 – 25% chromium and 16 – 22% tungsten, the total content of chromium plus tungsten being from 36 to 44%, and 0.1 – 1.0% aluminum, further containing at least one selected from the group consisting of 0.001 – 0.05% magnesium, 0.001 – 0.05% boron, 0.01 – 0.12% zirconium, 0.005 – 0.2% yttrium and 0.01 – 0.5% hafnium, and the balance being essentially nickel with incidental impurities.

4. A Ni-Cr-W alloy, which consists essentially of, by weight, 0.001 – 0.06% carbon, 0.1 – 0.6% titanium, niobium or a mixture thereof, 21 – 25% chromium and 16 – 20% tungsten, the total content of chromium plus tungsten being from 39 to 43%, the balance being essentially nickel with incidental impurities.

5. A Ni-Cr-W alloy, which consists essentially of, by weight, 0.001 – 0.06% carbon, 0.1 – 0.6% titanium, niobium or a mixture thereof, 21 – 25% chromium and 16 – 20% tungsten, the total content of chromium plus tungsten being from 39 to 43%, further containing at least one selected from the group consisting of 0.001 – 0.02% magnesium, 0.001 – 0.01% boron, 0.02 – 0.08% zirconium, 0.01 – 0.1% yttrium and 0.05 – 0.3% hafnium, and the balance being essentially nickel with incidental impurities.

6. A Ni-Cr-W alloy, which consists essentially of, by weight, 0.001 – 0.06% carbon, 0.1 – 0.6% titanium, niobium or a mixture thereof, 21 – 25% chromium, 16 – 20% tungsten, the total content of chromium plus tungsten being from 39 to 43%, and 0.1 – 0.5% aluminum, additionally at least one selected from the group consisting of 0.001 – 0.02% magnesium, 0.001 – 0.01% boron, 0.02 – 0.08% zirconium, 0.01 – 0.1% yttrium and 0.05 – 0.3% hafnium, and the balance being essentially nickel with incidental impurities.

7. The Ni-Cr-W alloy of claim 5, wherein only 0.02 – 0.08% zirconium is selected as an additional element.

8. The Ni-Cr-W alloy of claim 5, wherein 0.1 – 0.6% titanium is selected from both of titanium and niobium.

9. The Ni-Cr-W alloy of claim 6, wherein 0.1 – 0.6% titanium is selected from both of titanium and niobium.

10. The Ni-Cr-W alloy of claim 5, wherein 0.1 – 0.6% titanium and 0.02 – 0.08% zirconium are selected.

11. The Ni-Cr-W alloy of claim 5, wherein 0.1 – 0.6% titanium, 0.001 – 0.02% magnesium and 0.02 – 0.08% zirconium are selected.

12. The Ni-Cr-W alloy of claim 4, wherein the chromium content is about 23%.

13. The Ni-Cr-W alloy of claim 5, wherein the chromium content is about 23%.

14. The Ni-Cr-W alloy of claim 6, wherein the chromium content is about 23%.

15. The Ni-Cr-W alloy of claim 5, wherein the chromium content is about 23%, and 0.1 – 0.6% titanium and 0.02 – 0.08% zirconium are selected.

16. The Ni-Cr-W alloy of claim 5, wherein the chromium content is about 23%, and 0.1 – 0.6% titanium, 0.001 – 0.02% magnesium and 0.02 – 0.08% zirconium are selected.

17. The Ni-Cr-W alloy of claim 4, wherein the tungsten content is about 18%.

18. The Ni-Cr-W alloy of claim 5, wherein the tungsten content is about 18%.

19. The Ni-Cr-W alloy of claim 6, wherein the tungsten content is about 18%.

20. The Ni-Cr-W alloy of claim 5, wherein the tungsten content is about 18%, and 0.1 – 0.6% titanium and 0.02 – 0.08% zirconium are selected.

21. The Ni-Cr-W alloy of claim 5, wherein the tungsten content is about 18%, and 0.1 – 0.6% titanium, 0.001 – 0.02% magnesium and 0.02 – 0.08% zirconium are selected.

22. The Ni-Cr-W alloy of claim 5, wherein the carbon content is about 0.03%, the chromium content about 23%, the tungsten content about 18%, the total content of chromium plus tungsten about 41%, the titanium content about 0.3% and the zirconium content about 0.05%.

23. The Ni-Cr-W alloy of claim 5, wherein the carbon content is about 0.03%, the chromium content about 23%, the tungsten content about 18%, the total content of chromium plus tungsten about 41%, the titanium content about 0.4% and the zirconium content about 0.1%.

24. The Ni-Cr-W alloy of claim 5, wherein the carbon content about 0.02%, the chromium content about 23%, the tungsten content about 18%, the total content of chromium plus tungsten about 41%, the titanium content about 0.3%, the magnesium content about 0.004%, and the zirconium content about 0.06%.

25. Heat resistant parts comprising the alloy of claim 5.

26. Heat exchangers for atomic energy steel-making process, comprising the alloy of claim 5.

* * * * *

UNITED STATES PATENT OFFICE

CERTIFICATE OF CORRECTION

Patent No. 4,006,015 Dated February 1, 1977

Inventor(s) Rikizo Watanabe et al.

It is certified that error appears in the above-identified patent and that said Letters Patent are hereby corrected as shown below:

Between Lines [21] and [52], insert the following:

[30] Foreign Application Priority Data

August 7, 1974 Japan.....49-89876

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*